US005306588A

United States Patent [19]

Tanaka et al.

[11] Patent Number: 5,306,588

[45] Date of Patent: Apr. 26, 1994

[54] TREATED SILICA FINE POWDER AND TONER FOR DEVELOPING ELECTROSTATIC IMAGES

[75] Inventors: Katsuhiko Tanaka; Tsuyoshi Takigushi, both of Kanagawa; Rika Doi, Tokyo, all of Japan

[73] Assignee: Canon Kabushiki Kaisha, Tokyo, Japan

[21] Appl. No.: 854,001

[22] Filed: Mar. 19, 1992

[30] Foreign Application Priority Data

Mar. 19, 1991 [JP] Japan ..... 3-078183

[51] Int. Cl.[5] ..... G03G 9/08

[52] U.S. Cl. ..... 430/110; 106/287.1; 428/404

[58] Field of Search ..... 430/106, 110; 428/404; 106/287.1

[56] References Cited

U.S. PATENT DOCUMENTS

| | | | |
|---|---|---|---|
| 2,297,691 | 10/1942 | Carlsen | 430/121 |
| 3,720,617 | 3/1973 | Chatterji et al. | 252/62.1 |
| 3,819,367 | 6/1974 | Chatterji et al. | 96/15 D |
| 4,618,556 | 10/1986 | Takenouchi | 430/110 |
| 4,680,245 | 7/1987 | Suematsu et al. | 430/110 |
| 4,737,432 | 4/1988 | Tanaka et al. | 430/110 |
| 5,141,833 | 8/1992 | Kitamori et al. | 430/122 |

FOREIGN PATENT DOCUMENTS

| | | |
|---|---|---|
| 42-23910 | 11/1967 | Japan . |
| 43-24748 | 10/1968 | Japan . |
| 46-5782 | 12/1971 | Japan . |
| 49-42354 | 4/1974 | Japan . |
| 54-16219 | 2/1979 | Japan . |
| 56-64351 | 6/1981 | Japan . |
| 56-128956 | 10/1981 | Japan . |
| 58-216252 | 12/1983 | Japan . |
| 59-81650 | 5/1984 | Japan . |

*Primary Examiner*—Marion E. McCamish
*Assistant Examiner*—John Goodrow
*Attorney, Agent, or Firm*—Fitzpatrick, Cella, Harper & Scinto

[57] ABSTRACT

A treated silica fine powder and a toner having this powder to be used as a toner for developing an electrostatic image. The treated silica fine powder is formed of treated fine silica particles obtained by treating fine silica particles with (a) a first silane coupling agent in which at least one of a substituted secondary alkyl group, an unsubstituted secondary alkyl group, a substituted tertiary alkyl group, an unsubstituted tertiary alkyl group, a substituted cyclic hydrocarbon group and an unsubstituted cyclic hydrocarbon group is bonded to a silicon atom of the silane coupling agent, and by thereafter treating the resultant fine particles of silica with a second silane coupling agent having the formula $$(R_1)_m Si(Y)_n$$

wherein R1 represents a methyl group, a halomethyl group, a saturated straight chain hydrocarbon group or an unsaturated straight chain hydrocarbon group; Y represents an alkoxy group or a halogen group; m represents an integer of 1 to 3; n represents an integer of 1 to 3; and m and n are 4.

17 Claims, 1 Drawing Sheet

TREATED SILICA FINE POWDER AND TONER FOR DEVELOPING ELECTROSTATIC IMAGES

BACKGROUND OF THE INVENTION

Field of the Invention

This invention relates to a treated fine powder of silica constituting a toner for developing an electrostatic latent image in a process of image forming, such as electrophotography, electrostatic recording, electrostatic printing or the like, and to an electrostatic image development toner having such a treated fine powder of silica.

Hitherto, various electrophotography methods are known, including those disclosed in U.S. Pat. No. 2,297,691, and in Japanese Patent Publication Nos. 42-23910 and 43-24748.

Generally, development methods applicable to these electrophotography methods ar grouped into dry development methods and wet development methods. The former are further grouped into methods using a two-component type developer and methods using one-component type developer.

Conventionally, in these dry development methods, a fine powder formed by dispersing a dye and/or a pigment in a natural resin or a synthetic resin is used. For example, a fine powder having a particle size of 1 to 30 μm, which has been and formed by pulverizing a binder such as polystyrene having a colorant disposed therein is typically used as a toner. As magnetic toners, powders containing particles of a magnetic material such as magnetite are used. In the case of a method using a two-component type developer, a toner is ordinarily used by being mixed with carrier particles, such as glass beads or iron particles.

It is necessary for each type of toner to have positive or negative charge according to the polarity of an electrostatic latent image to be developed. For this effect, a compound called a charge control agent is ordinarily added to the toner.

Various chemical substances are added to a toner according to image fixation performance and other characteristics required.

In particular, a method of adding a fine silica powder to the outer surface of a toner particle to achieve a desired fluidity of the toner is widely used for the purpose of improving image characteristics such as resolution, density uniformity and fog level.

This method addresses the problem of the increased degree of dependence of these image qualities upon the environment. The use of a toner prepared in this manner is presently enabled by a special means, e.g., a heater provided in a copier or other additives. However, remodeling a main unit of a copier to improve image characteristics also results in an increase in price. Further the addition of other additives may cause different problems. This problem is particularly serious in the case of a full-color copier which must be capable reproducing a half-tone image with high fidelity. In this technical field, therefore, there is a strong need to develop a fine silica powder which, when added to the outer surface of a toner, can significantly reduce changes in the performance of the toner under environmental influences.

SUMMARY OF THE INVENTION

An object of the present invention is to provide a fine silica powder free from the above-described problems and an electrostatic image development toner having this fine silica powder.

Another object of the present invention is to provide a fine silica powder "that, when used to form a toner, is" capable of reducing the degree of dependence of the toner upon environment.

Still another object of the present invention is to provide an electrostatic image development toner containing a fine silica powder and exhibiting a reduced degree of dependence upon the environment.

A further object of the present invention is to provide an electrostatic image development toner containing a fine silica powder, which exhibits a reduced degree of dependence upon the environment, improved performance in reproducing a half-tone image, and the ability to produce a full-color image.

To achieve these objects, according to one aspect of the present invention, there is provided a treated, fine powder of silica comprising treated fine particles of silica, the treated fine particles being obtained by (1) treating fine particles of silica with a silane coupling agent, in which there is bonded to a silicon atom in the silane coupling agent at least one of the group consisting of a substituted secondary alkyl group, an unsubstituted secondary alkyl group, a substituted tertiary alkyl group, an unsubstituted tertiary alkyl group, a substituted cyclic hydrocarbon group, and an unsubstituted cyclic hydrocarbon group; and (2) thereafter, further treating the resultant fine particles of silica with a second silane coupling agent represented by the following formula:

$$(R_1)_m Si(Y)_n$$

wherein R1 represents a methyl group, a halomethyl group, a saturated straight chain hydrocarbon group, or an unsaturated straight chain hydrocarbon group; Y represents an alkoxyl group or a halogen group; m represents an integer of 1 to 3; n represents an integer of 1 to 3 and the sum of m and n is 4.

According to another aspect of the present invention, there is provided a toner for developing electrostatic images comprising toner particles and a treated fine powder of silica, wherein (1) the toner particles comprise a binder resin and a colorant, and (2) the fine powder of silica comprises treated fine particles of silica that have been obtained by (a) treating fine particles of silica with a silane coupling agent, in which there is bonded to a silicon atom at least one of a substituted secondary alkyl group, an unsubstituted secondary alkyl group, a substituted tertiary alkyl group, an unsubstituted tertiary alkyl group, a substituted annular hydrocarbon group, and an unsubstituted annular hydrocarbon group (2) further treating the resultant fine particles of silica with a second silane coupling agent represented by the following formula:

$$(R_1)_m Si(Y)_n$$

wherein R1 represents a methyl group, a halomethyl group, a saturated straight chain hydrocarbon group or an unsaturated straight chain hydrocarbon group; Y represent an alkoxy group or a halogen group; m represents an integer of 1 to 3; n represents an integer of 1 to 3; and the sum of m and n is 4.

DESCRIPTION OF THE PREFERRED EMBODIMENTS

Figure 1:
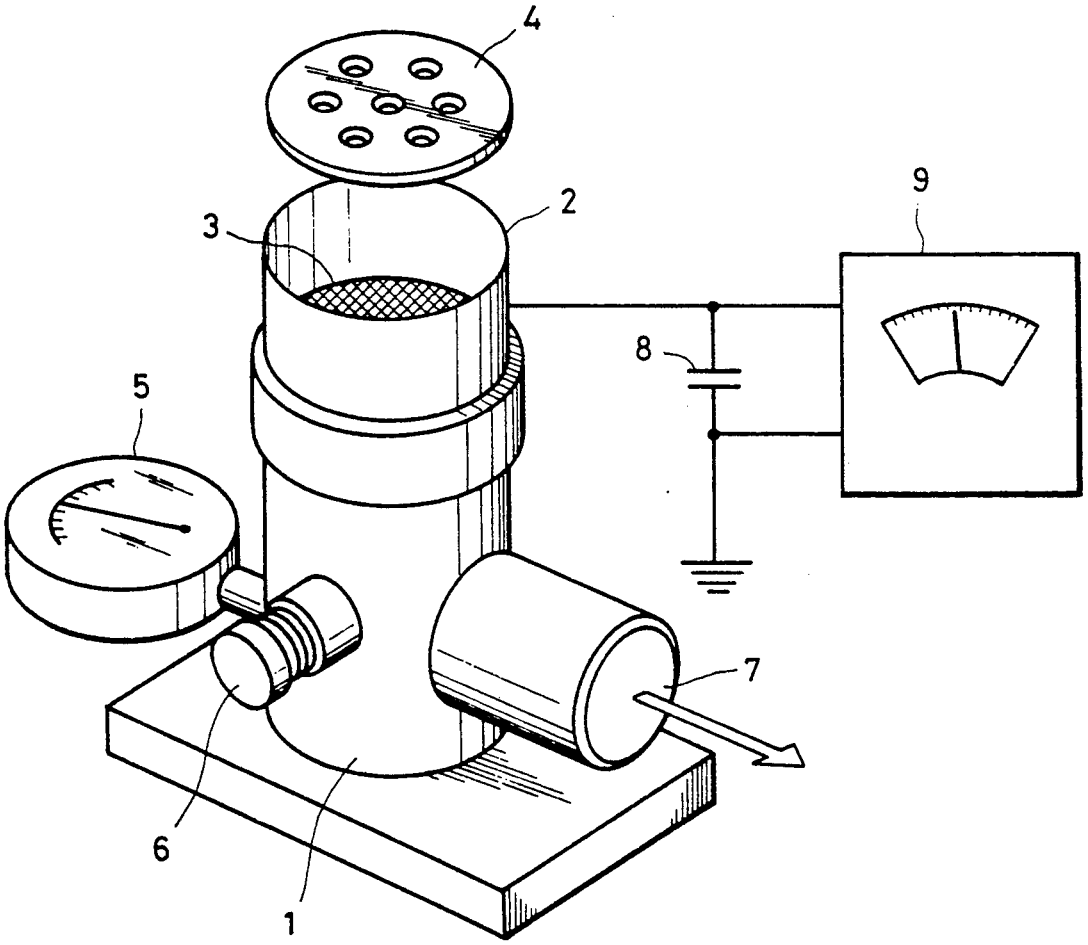
FIG. 1 is a diagram of a triboelectric charge measurement apparatus for measuring a triboelectric charge on a toner and a fine powder of silica.

One method ordinarily used to obtain a toner having a reduced degree of dependence upon the environment, i.e., exhibiting improved stability under varying environmental influences, is based on increasing the hydrophobicity of a fine powder of silica added to the outer surfaces of toner particles, i.e., reducing the water absorbance of the silica powder so that a triboelectric charge on the silica powder is stabilized.

More specifically, to achieve this effect, a fine silica powder may be treated with a silicone oil, as disclosed in Japanese Patent Laid-Open Publication No. 49-42354. Alternately, a hydrophobic fine silica powder may be added to the outer surfaces of toner particles, as disclosed in Japanese Patent Laid-Open Publication No. 54-16219, or a fine powder of silica that has been treated with a silane coupling agent may be added to the outer surface of a toner particle as disclosed in Japanese Patent Laid-Open Publication Nos. 46-5782, 56-64351, and 56-128956.

Thus, various techniques have been developed for the purpose of improving the hydrophobicity of a silica powder.

However, studies made by the inventors of the present invention have revealed that it is difficult to improve the hydrophobicity of a silica powder by the techniques disclosed in these publications alone. For example, the hydrophobicity of a fine silica powder that has been treated only with a treatment agent such as hexamethyldisilazine or dimethyldichlorosilane in which the number of carbon atoms of substituent groups bonded to each silicon atom is 2 or less, is insufficient. This is clear from the fat that, if the treated fine silica powder is put in a water solution containing no surfactant, particles of the powder are dispersed in the water rather than floating on the surface of the water.

Japanese Patent Laid-Open Publication No. 59-81650 describes a method of treating a fine silica powder with a treatment agent in which the number of carbon atoms of the substituent groups bonded to each silicon atom is 8. The inventors have examined this method and found that the improvement in the hydrophobicity of a fine silica powder achieved by this method is still insufficient. That is, as the number of carbon atoms in the substituent groups bonded to each silicon atom is increased, the steric hindrance thereof becomes so large that silanol groups at the surface of the silica powder, which exist at small intervals of 5 to 6 Å cannot be entirely treated. This is clear from an analysis of the amount of silanol groups remaining on several particles of the treated silica powder.

If silanol groups remain on the silica powder, the change in triboelectric charge on the silica powder due to environmental factors cannot be sufficiently limited, and the desired environment in stability cannot be achieved.

In the course of improving the stability of triboelectric charge on a fine silica powder with respect to environmental changes, the inventors have noted the generation of charge as a fundamental phenomenon and started improving the stability of triboelectric charge on silica with respect to environmental changes through improving the surface qualities of silica by surface treatments.

It is known that the triboelectric charging performance of a fine silica powder treated with a silane coupling agent is greatly influenced by the composition of the treatment agent. It is well known that a fine silica powder that has been surface-treated with a trimethylsilyl group has a negatively chargeable property. Further, in Japanese Patent Laid-Open Publication No. 58-216252, a fine silica powder that was treated with a silane coupling agent containing nitrogen atoms is used as a positively chargeable silica powder.

Considering that the environment-dependence of the triboelectric charge on a treated fine silica powder is due to the composition of the treatment agent, the inventors have studied the composition of treatment agents and various treatment methods to develop fine silica powder from which triboelectric charge cannot be easily removed even under a conditions of high humidity.

Ordinary silane coupling agents having no amino group have a negatively chargeable property, which is considered to be due to the presence of silicon atoms (i.e., Si-C bonding). The inventors have therefore studied methods of limiting the reduction in triboelectric charge under high-humidity conditions by limiting the adsorption of water molecules around silicon atoms.

The inventors have found that a fine silica powder that is improved with respect to the stability of triboelectric charge with environmental changes can be obtained if a large-capacity substituent group, such as one having a large number of carbon atoms, is introduced as a substituent group bonded to silicon atoms in a treatment agent, thus preventing the coordination of water molecules to the silicon atoms of the fine silica powder. However, it is said that the distance between silanol groups at the surface of particles of an untreated fine silica powder is 5 to 6 Å. Accordingly, and it is difficult to treat all silanol groups only with a treatment agent in which substituent groups having a width greater than this distance are bonded to silicon atoms. On the other hand, where a silica powder is treated only with a treatment agent in which small-capacity substituent groups are bonded to silicon atoms, almost all of the silanol groups at the surface of the silica particles are treated, but the degree of contribution to the stabilization of triboelectric charge on the silica powder with respect to environmental changes is small.

The inventors have further discovered that a fine silica powder can be obtained by first treating fine silica particles with a silane coupling agent, in which large-capacity substituent groups are bonded to silicon atoms, and then treating the silica particles with another silane coupling agent, in which small-capacity substituent groups are bonded to silicon atoms.

Original fine silica particles, from which a fine silica powder in accordance with the present invention is formed by treatment with silane coupling agents, may be obtained by a dry process or a wet process. However, to achieve the desired fluidity as an essential property of a fine silica powder, silica particles obtained by a dry process are preferred.

A "dry process," as referred to hereafter, is a process of producing silica particles by vapor phase oxidation of a silicon halogen derivative, e.g., a process utilizing the thermal decomposition oxidation reaction of silicon tetrachloride gas in oxyhydrogen. The following is a formula of a basic reaction of this process.

$$SiCl_4+2H_2+O_2 \rightarrow SiO_2+4HCl$$

In this production process, a metallic halogen derivative, such as aluminum chloride or titanium chloride, may be used along with the metal halogen derivative to obtain fine composite particles of silica and a metallic oxide. The fine silica particles used in accordance with the present invention also include such composite particles.

As a method of producing fine silica particles used in accordance with the present invention by a wet process, various well-known conventional methods can be used. For example, a method of forming silica by decomposing sodium silicate with an acid may be used. The following is a general reaction formula of this method.

$$Na_2O{\cdot}XSiO_2+HCl+H_2O \rightarrow SiO_2{\cdot}nH_2O+NaCl$$

Other examples of the wet-process production method, which will not be explained here with reaction formulae, are a method of forming silica by decomposing sodium silicate with ammonia salt or alkali salt, a method of forming a silicate of an alkaline earth metal from sodium silicate and decomposing the metallic silicate by an acid to form silica, a method of forming silica from a sodium silicate solution by means of an ion exchange resin, and a method of utilizing natural silica or silicate.

To obtain fine silica particles in accordance with the present invention, any of anhydrous silicon dioxide (silica) and silicates, such as aluminum silicate, sodium silicate, potassium silicate, magnesium silicate, and zinc silicate, can be used.

Considering the effect of the fine silica powder of the present invention, the specific surface area in terms of nitrogen adsorption, as measured by the BET method, is preferably 30 $m^2/g$ or above, more preferably, 50 to 400 $m^2/g$.

The fine silica powder of the present invention is a powder having a negatively chargeable property.

There are many organic groups that can be a portion of a silane coupling agent negatively chargeable by triboelectricity. However, it is most preferable to use one which is thought to have the desired property due to Si-C bonding, as mentioned above. The negatively chargeable property due to Si-C bonding is greatly influenced by the properties of a hydrocarbon directly bonded to Si. It is, therefore, possible to control the amount of charge on the fine silica powder by selecting a substituent group having a suitable electronic effect.

It is necessary to use a first silane coupling agent in which at least one large-capacity substituent group is bonded to each silicon atom. This coupling agent is used to treat original fine silica particles for the first time to obtain the fine silica powder in accordance with the present invention.

Examples of such a large-capacity substituent group are a substituted secondary alkyl group, an unsubstituted secondary alkyl group, a substituted tertiary alkyl group, an unsubstituted tertiary alkyl group, a substituted cyclic hydrocarbon group, and an unsubstituted cyclic hydrocarbon group.

The number of carbon atoms of the secondary and tertiary alkyl groups is preferably 3 to 18, and groups substituted to them are, preferably, a halogen group, a phenyl group and/or a derivative of the same.

As a cyclic hydrocarbon, a phenyl group, a derivative of the same, a cyclohexyl group or a derivative of the same is preferred. A preferred substituent group for a cyclic hydrocarbon is an alkyl group having 1 to 8 carbon atoms.

Examples of first silane coupling agents that are useful for the first treatment, include those listed below.

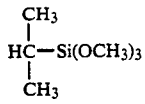
(1)

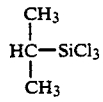
(2)

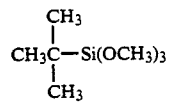
(3)

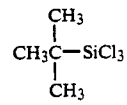
(4)

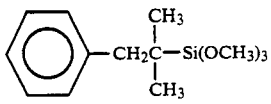
(5)

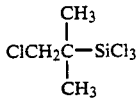
(6)

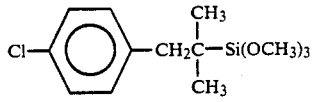
(7)

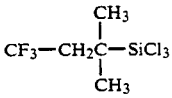
(8)

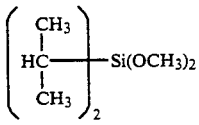
(9)

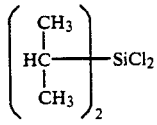
(10)

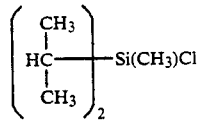
(11)

-continued
(12)
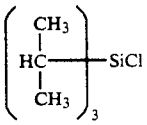
(13)
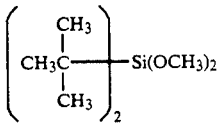
(14)
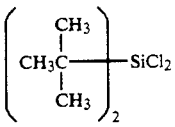
(15)
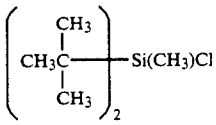
(16)
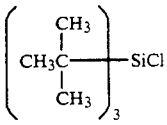
(17)
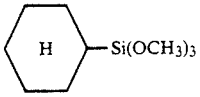
(18)
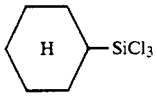
(19)
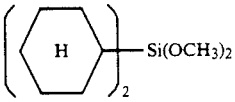
(20)
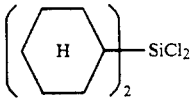
(21)
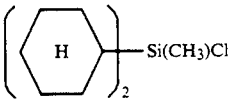
(22)
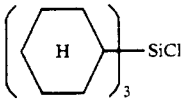
(23)
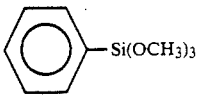
-continued
(24)
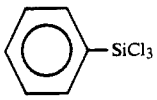
(25)
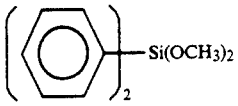
(26)
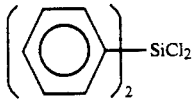
(27)
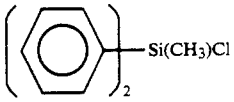
(28)
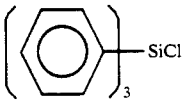
(29)
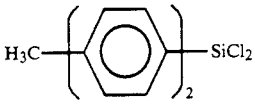
(30)
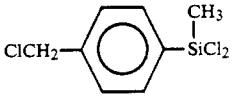
(31)
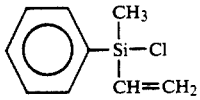
(32)
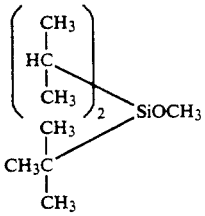
(33)
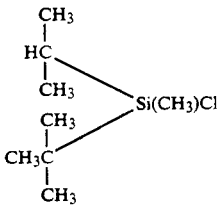

-continued
(34)
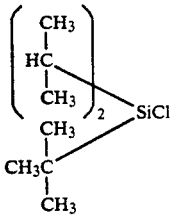
(35)
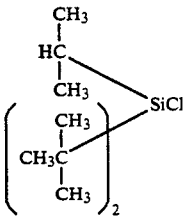
(36)
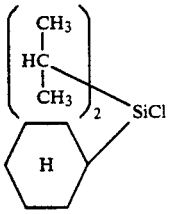
(37)
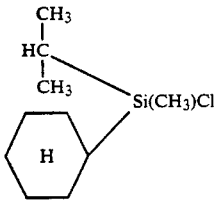
(38)
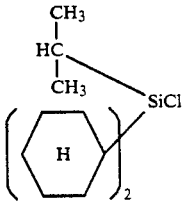
(39)
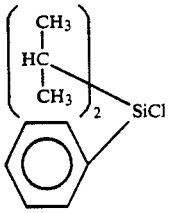
(40)
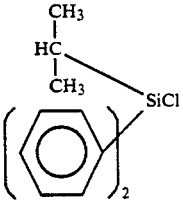
-continued
(41)
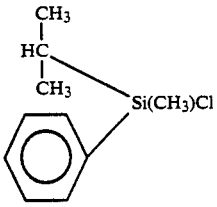
(42)
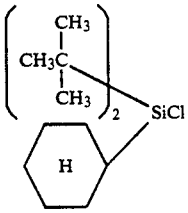
(43)
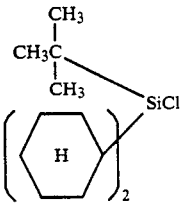
(44)
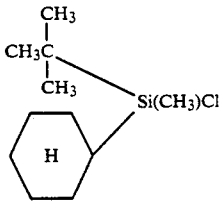
(45)
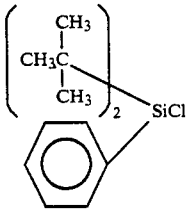
(46)
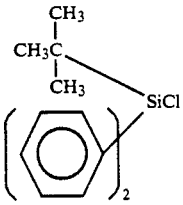
(47)
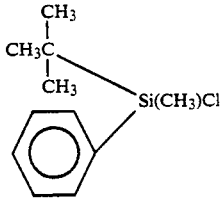

-continued

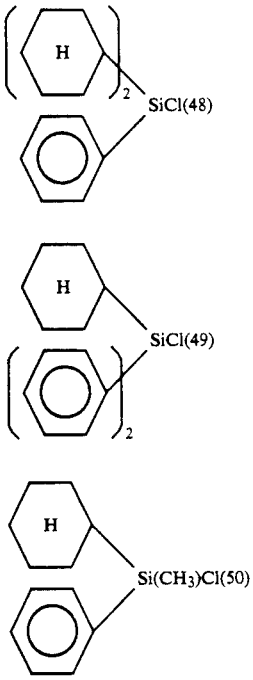

It is necessary to use, as a second coupling agent for treating the fine silica particles for the second time to obtain the fine silica powder of the present invention, a silane coupling agent in which there are bonded to the silicon atoms of the silane coupling agent only substituent groups having a capacity smaller than that of the large-capacity substituent groups that are bonded to the silicon atoms of the first silane coupling agent.

Examples of such small-capacity substituent groups are an alkoxy group, a halogen group and a substituent group represented by the following formula:

$$-CH_2R_1$$

Where $R_1$ represents one of a hydrogen atom, a halogen atom, a saturated straight chain hydrocarbon and an unsaturated straight chain hydrocarbon.

In the second silane coupling agent, it is necessary that only an alkoxy group and/or a halogen group, and a substituent group represented by the following formula:

$$-CH_2R_1$$

Where $R_1$ represents one of a hydrocarbon atom, a halogen atom, a saturated straight chain hydrocarbon and an unsaturated straight chain hydrocarbon is are bonded to a silicon atom of the second coupling agent.

If the small-capacity substituent group is an alkoxy group, the number of carbon atoms is preferably 1 or 2, more preferably, 1.

If the substituent group is a saturated or unsaturated straight chain hydrocarbon represented by $R_1$ in the above formula the number of carbon atoms is preferably 1 to 3.

Examples of the second silane coupling agent for the second treatment, which are not exclusive, are listed below.

| | |
|---|---|
| $(CH_3)_3SiOCH_3$ | (51) |
| $(CH_3)_3SiCl$ | (52) |
| $CH_3)_2Si(OCH_3)_2$ | (53) |
| $(CH_3)_2SiCl_2$ | (54) |
| $CH_3Si(OCH_3)_3$ | (55) |
| $CH_3CH_2(CH_3)_2SiOCH_3$ | (56) |
| $CH_3CH_2(CH_3)_2SiCl$ | (57) |
| $CH_3CH_2(CH_3)Si(OCH_3)_2$ | (58) |
| $CH_3CH_2(CH_3)SiCl_2$ | (59) |
| $CH_3CH_2Si(OCH_3)_3$ | (60) |
| $CH_3CH_2SiCl_3$ | (61) |
| $(CH_3CH_2)_3SiOCH_3$ | (62) |
| $(CH_3CH_2)_3SiCl$ | (63) |
| $(CH_3CH_2)_2Si(OCH_3)_2$ | (64) |
| $(CH_3CH_2)_2SiCl_2$ | (65) |

Fine silica particles can be treated with silane coupling agents by various methods. For example, a silane coupling agent in a vapor phase may be sprayed onto fine silica particles while the particles are being agitated in a nitrogen atmosphere and heated to a temperature of 100° to 200° C., thereby obtaining a treated fine silica powder.

A toner for developing an electrostatic image in accordance with the present invention, i.e., toner particles having outer surfaces to which the fine silica powder of the present invention is added, will be described below.

The amount of fine silica powder applied to toner particles in accordance with the present invention is preferably 0.01 to 5 parts by weight, more preferably, 0.05 to 2 parts by weight, per 100 parts by weight of toner particles. A combination of two or more treated fine silica powders of the present invention or a combination of some of the fine treated silica powders of the present invention and well-known, conventional fine silica powders can be used as a powder to be added to the toner.

Examples of a binder resin for forming toner particles used in accordance with the present invention are styrene and monomers of substitution products of styrene, such as polystyrene, poly-p-chlorostyrene and polyvinyltoluene; styrene copolymers, such as styrene-p-chlorostyrene copolymer, styrene-vinyltoluene copolymer, styrene-vinylnaphthalene copolymer, styrene-acrylic ester copolymer, styrene-methacrylic ester copolymer, styrene-α-chloromethyl acrylate copolymer, styrene-acrylonitrile copolymer, styrene-vinylmethyl ether copolymer, styrene-vinylethyl ether copolymer, styrene-vinylmethylketone copolymer, styrene-butadiene copolymer, styrene-isoprene copolymer and styrene-acrylonitrile-indene copolymer; polyvinyl chloride, phenolic resin, natural modified phenolic resin, natural resin modified maleic resin, acrylic resin, methacrylic resin, polyvinyl acetate, silicone resin, polyester resin, polyurethane, polyamide, furane resin, epoxy resin, xylene resin, polyvinyl butyral, terpene resin, coumarone-indene resin, and petroleum resin. A styrene copolymer may be cross-linked. As a comonomer for styrene monomers of such styrene copolymers is used one, or a combination of two or more, of the following compounds: monocarboxylic acid having a double bond and substitution products of the same, e.g., acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acid having a double bond and substitution products of the same, e.g., maleic acid, butyl maleate, methyl maleate and dimethyl maleate; vinyl esters, e.g., vinyl chloride, vinyl acetate and vinyl benzoate; ethylenic olefins, e.g., ethylene, propylene and butylene; vinylketones, e.g., vinylmethylketone and vinylhexylketone; and vinyl monomers such as vinyl ethers, e.g., vinylmethyl ether, vinylethyl ether and isobutyl ether. As a cross-linking agent, a derivative having two or more polymerizable double bonds is mainly used. Such a cross-linking agent may be one or a mixture of some of the following compounds: aromatic divinyl derivatives, e.g., divinylbenzene and divinylnaphthalene; carboxylic acid esters having two double bonds, e.g., ethylene glycol diacrylate, ethylene glycol dimathacrylate and 1,3-butanediol dimathacrylate; divinyl derivatives, e.g., divinyl aniline, divinyl ether, divinyl sulfide and divinyl sulfone; and derivatives having at least three vinyl groups.

If the toner for developing electrostatic images of the present invention is fixed by a pressure fixation method, a pressure fixation toner binder resin can be used which may be, for example, polyethylene, polypropylene, polymethylene, polyurethane elastomer, ethylene-ethylacrylate copolymer, ethylene-vinyl acetate copolymer, ionomer resin, styrene-butadiene copolymer, styrene-isoprene copolymer, linear saturated polyester or paraffin.

To give toner particles a negatively chargeable characteristic, it is preferable to add a negative charge control agent which may be any of well-known agents of this kind. Examples of such a charge control agent are a complex of a salicylic acid derivative, a complex of a monoazo derivative, a phenolic derivative, an organic acid such as carboxylic acid or sulfonic acid, and polymers having these compounds as side chains. A slight amount of a positive charge control agent may be added to finely control triboelectric charge on toner particles. Needless to say, a triboelectric property of the binder resin can be utilized without using charge control agents.

As colorants available for toner particles, in accordance with the present invention, can be used one or a mixture of some of the well-known pigments or dyestuffs: carbon black, lamp black, ultramarine, Nigrosine dye, Aniline Blue, Phthalocyanine Blue, Phthalocyanine Green, Hanza Yellow G, Rhodamine 6G, Chalco Oil Blue, Chrome Yellow, quinacridone, Benzidine Yellow, Rose Bengale, triarylmethane dyes/pigments, monoazo dyes/pigments, dis-azo dyes/pigments, and other materials.

The toner for developing electrostatic images; of the present invention can be used as a two-component type developer by being mixed with a carrier, which may be selected from well-known materials, e.g., magnetic powders, such as iron powder, ferrite powder and nickel powder, glass beads, and particles of these materials coated with a resin. As a coating resin covering the carrier surface, styrene-acrylic ester copolymer, styrene-methacrylic ester copolymer, acrylic ester copolymer, methacrylic ester copolymer, silicone resin, fluorine containing resin, polyamide resin, ionomer resin, or polyphenylene sulfide resin, or a mixture of some of these resins can be used.

The toner for developing electrostatic images of the present invention can be used as a magnetic toner and as a one-component type developer by including a magnetic material in toner particles. This magnetic material may be an iron oxide such as magnetite, $\gamma$-iron oxide, ferrite, excess-iron type ferrite, a metal such as iron, cobalt or nickel, or an alloy or mixture of some of these metals and other metals such as aluminum, cobalt, copper, lead, magnesium, tin, zinc, antimony, beryllium, bismuth, cadmium, calcium, manganese, selenium, titanium, tungsten and vanadium. The magnetic material has an average particle size of, preferably, about 0.1 to 1 $\mu$m, more preferably, about 0.1 to 0.55 $\mu$m, and the content of the magnetic material in magnetic toner is, preferably, 20 to 150 parts by weight, more preferably, 30 to 120 parts by weight per 100 parts by weight of the binder resin component.

Additives may be added to the toner for developing electrostatic images in accordance with the present invention. Examples of additives are a lubricant such as zinc stearate, an abrasive such as silicon carbide, a fluidizing agent such as aluminum oxide, a caking preventing agent, and a conductivity-providing agent such as carbon black or tin oxide.

A fluorine containing polymer powder such as polyvinylidene fluoride powder is also preferred in terms of fluidity, polishing and charge stability.

Further, in a preferred form of the present invention, 0.5 to 5% by weight based on the toner of a wax-like material such as low molecular weight polyethylene, low molecular weight polypropylene, microcrystalline wax, carnaubic acid, sasol wax or paraffin wax is added to toner particles in accordance with the present invention for the purpose of improving releasing performance at the time of hot roll fixation.

As a method of producing toner particles in accordance with the present invention, one method is preferred in which toner constituent materials such as those described above are sufficiently mixed by a mixer, e.g., a ball mill or the like; are thereafter kneaded sufficiently by a kneader, e.g., a hot roll kneader, an extruder of the like; and are mechanically pulverized and classified after being cooled and solidified to obtain toner particles. Other methods include, e.g., a method of obtaining toner particles by dispersing constituent materials in a binder resin solution and thereafter spraying and drying the solution; polymerization toner production method in which predetermined materials are mixed with monomers which are to constitute a binder resin so that an emulsified suspension is formed, and the monomers are thereafter polymerized to obtain toner particles and a method of preparing a microcapsule toner having a core material and a shell material so that one or both of these materials contain predetermined materials. The electrostatic image development toner in accordance with the present invention can be produced by sufficiently mixing, with prepared toner particles, a fine silica powder treated in accordance with the present invention and, if necessary, desired additives by a mixer such as a Henschel mixer.

The toner for developing electrostatic images of the present invention can be used to develop an electrostatic image in any development process for electrophotography, electrostatic recording or electrostatic printing using well-known means.

A measuring method in accordance with the present invention will be described below.

(1) Triboelectric Charge Measurement

A method of measuring triboelectric charge on the toner and the fine silica powder will be described below in detail with reference to the drawing.

FIG. 1 is a diagram of an apparatus for measuring triboelectric charge on the toner and the fine silica powder. About 0.5 to 1.5 g of a specimen having triboelectric charge to be measured is put in a metallic measurement container 2 having a screen 3 of 500 mesh disposed at its bottom. This specimen consists of a mixture of a toner and an iron powder carrier mixed at a ratio of 1:9 by weight, or a mixture of a fine silica powder and an iron powder carrier mixed at a ratio of 1:99 by weight by being manually shaken for 10 to 40 seconds in a polyethylene bottle having a capacity of 50 to 100 ml. The measurement container 2 is capped with a metallic cap 4. Then the weight of the whole measurement container 2 containing the specimen is measured and set as $W_1$. Next, in a suction unit 1 (in which at least a portion to be brought into contact with the measurement container 2 is formed of an insulating material), air is sucked through a suction port 7 and the pressure indicated by a vacuum gauge 5 is set to 250 mmAq by adjusting a flow rate control valve 6. In this state, air is sufficiently sucked, preferably for 2 minutes to suck and remove the toner or the fine silica powder. The voltage indicated by a voltmeter 9 at this time is set as V. The capacitance of a capacitor 8 is set as C (μF). The weight of the whole measurement container is measured after this sucking and is set as $W_2$. Then, the triboelectric charge (μc/g) on the toner and the fine silica powder is calculated by the following formula:

Triboelectric charge (μc/g) on toner and fine silica powder $$= \frac{C \times V}{W_1 - W_2}$$

(under measurement conditions: temperature of 23° C., humidity of 60% RH).

As the iron carrier for this measurement, EFV 200/300 (a product of Powder Tec) is used.

In accordance with the present invention, fine silica particles are treated with a silane coupling agent in which a large-capacity substituent group is bonded to each silicon atom, and are thereafter treated with a second silane coupling agent in which a small-capacity substituent group is bonded to each silicon atom. In the fine silica powder consisting of the fine silica particles thereby treated, silanol groups in the surface of the fine silica particles are first treated with the silane coupling agent in which a large-capacity substituent group is bonded to each silicon atom, and the silanol groups remaining after this treatment are treated with the second silane coupling agent in which a small-capacity substituent group is bonded to each silicon atom. This fine silica powder is therefore stable with respect to environmental changes, and a toner containing this powder exhibits a reduced degree of dependence upon the environment.

The toner for developing electrostatic images of the present invention has the above-described treated fine silica powder and therefore exhibits a reduced degree of dependence upon the environment and an improvement in image reproducibility. Also, it can suitably be used with a color toner for obtaining a full-color image.

Examples of the present invention, which are not limiting but illustrative of the present invention, will be described below. Amounts of the constituents of all the compositions described below are shown as parts by weight.

| | |
|---|---|
| Styrene/butyl methacrylate copolymer | 100 parts |
| Carbon black | 5 parts |
| Low molecular weight polypropylene wax | 2 parts |
| Cr complex of 3,5-di-t-butyl salicylate | 2 parts |

These materials were sufficiently mixed by a blender and were kneaded by a two-shaft kneading extruder set at 150° C. The kneaded mixture obtained was cooled, roughly pulverized by a cutter mill and thereafter pulverized finely by a pulverizer using a jet air flow. A finely pulverized powder thereby obtained was classified by a fixed-wall-type air classifier to obtain refined classified powder.

Further, the resulting classified powder was strictly classified with respect to ultrafine and coarse powders simultaneously by a multiple-class classifier utilizing the Coanda effect (an elbow jet classifier manufactured by Nitetsu Kogyo K.K.), thereby obtaining a negatively chargeable fine black powder (toner particles) having a volume average particle size of 8.8 μm.

One hundred parts by weight of fine silica particles (Aerosil 200, manufactured by Nippon Aerosil Co.) were treated with 50 parts by weight of the silane coupling agent shown as compound example (4) at a temperature of 150° C. for 2 hours, and were thereafter treated with the silane coupling agent shown as compound example (52) at a temperature of 150° C. for 2, thereby obtaining a treated fine silica powder in accordance with the present invention.

0.5 part of this treated fine silica powder was added to the outer surfaces of 100 parts of the above fine black powder particles, thereby obtaining a black toner.

6 parts of the obtained electrostatic image development toner was mixed with 100 parts of an acryl-coated ferrite carrier having an average particle size of 65 μm to form a two-component type developer.

This two-component developer was used in a color copying machine on the market (CLC-500, manufactured by Canon K.K.) to meet the requirements of a toner copying test without environmental correction.

An image obtained in an environment of a temperature of 23° C. and a humidity of 60% RH had a sufficiently high image density (1.41) and was clear. Also, the image was excellent in solid image density uniformity and in half-tone image reproducibility. Images were also formed in an environment of a temperature of 15° C. and a humidity of 10% RH and in an environment of a temperature of 35° C. and a humidity of 90% RH. These images had image densities of 1.43 and 1.40. Substantially no change in image density due to the changes in environment was observed. Substantially no changes in image quality with respect to solid image density uniformity and half-tone image reproducibility due to the environmental changes were observed.

The amounts of silanol groups remaining in the surface of the fine silica particles before and after the second treatment and the changes in the amount of triboelectric charge on the fine silica powder with respect to environmental changes were as shown in Table 1. As can be understood from Table 1, the amounts of triboelectric charge on the toner surfaces to which the fine silica powder was added, reflect the characteristics of the added fine silica powder.

EXAMPLE 2

A negatively chargeable fine blue powder was obtained in the same manner as Example 1 except that 5 parts of carbon black in Example 1 was changed to 4 parts of a copper phthalocyanine pigment (C.I. Pigment Blue 15).

One hundred parts by weight of fine silica particles (Aerosil 200, manufactured by Nippon Aerosil Co.) were treated with the silane coupling agent shown as compound example (4) at a temperature of 150° C. for 2 hours, and were thereafter treated with the silane coupling agent shown as compound example (55) at a temperature of 150° C. for 2 hours, thereby obtaining a treated fine silica powder in accordance with the present invention.

0.5 part of this treated fine silica powder was added to the outer surfaces of 100 parts of the above fine blue powder, thereby obtaining a cyan toner.

6 parts of the obtained cyan toner was mixed with 100 parts of an acryl-coated ferrite carrier having an average particle size of 65 μm to form a two-component type developer.

This two-component type developer was used to effect a toner copying test in the same manner as Example 1.

An image obtained in an environment of a temperature of 23° C. and a humidity of 60% RH had a sufficiently high image density (1.41) and was clear. Also, the image was excellent in solid image density uniformity and in half-tone image reproducibility. Images were also formed in an environment of a temperature of 15° C. and a humidity of 10% RH, and an environment at a temperature of 35° C. and a humidity of 90% RH. These images had image densities of 1.42 and 1.41. Substantially no change in image density due to the environmental changes was observed. Substantially no changes in image quality with respect to solid image density uniformity and half-tone image reproducibility due to the environmental changes were observed.

The amounts of silanol groups remaining on the surface of the fine silica particles before and after the second treatment and the changes in the amount of triboelectric charge on the fine silica powder with respect to environmental changes were as shown in Table 1. As can be understood from Table 1, the amounts of triboelectric charge on the toner particles, to which the fine silica powder was added, reflect the characteristics of the added fine silica powder.

EXAMPLE 3

A negatively chargeable fine red powder was obtained in the same manner as Example 1, except that 5 parts of carbon black in Example 1 was changed to 3.5 parts of a quinacridone pigment (C.I. Pigment Red 15).

One hundred parts by weight of fine silica particles (Aerosil 200, manufactured by Nippon Aerosil Co.) were treated with the silane coupling agent shown as compound example (17) at a temperature of 150° C. for 2 hours), and were thereafter treated with the silane coupling agent shown as compound example (54) (at a temperature of 150° C. for 2 hours, thereby obtaining a treated fine silica powder in accordance with the present invention.

0.5 part of this treated silica powder was added to the outer surfaces of 100 parts of the above fine red powder particles, thereby obtaining a magenta toner.

6 parts of the obtained magenta toner was mixed with 100 parts of an acryl-coated ferrite carrier having an average particle size of 65 μm to form a two-component type developer.

This two-component type developer was used to effect a toner copying test in the same manner as Example 1.

The image obtained in an environment of a temperature of 23° C. and a humidity of 60% RH had a sufficiently high image density (1.43) and was clear. Also, the image was excellent in solid image density uniformity and in half-tone image reproducibility. Images were also formed in an environment of a temperature of 15° C. and a humidity of 10% RH, and in an environment of a temperature of 35° C. and a humidity of 90% RH. These images had image densities of 1.42 and 1.45. Substantially no change in image density due to the environmental changes was observed. Substantially no changes in image quality with respect to solid image density uniformity and half-tone image reproducibility due to the environmental changes were observed.

The amounts of silanol groups remaining on the surface of the fine silica particles before and after the second treatment and the changes in the amount of triboelectric charge on the fine silica powder with respect to environmental changes were as shown in Table 1. As can be understood from Table 1, the amounts of triboelectric charge on the toner particles to which the fine silica powder was added reflect the characteristics of the added fine silica powder.

EXAMPLE 4

A negatively chargeable fine yellow powder was obtained in the same manner as Example 1, except that 5 parts of carbon black in Example 1 was changed to 5 parts of an azo pigment (C.I. Pigment Yellow 15).

One hundred parts by weight of fine silica particles (Aerosil 200, manufactured by Nippon Aerosil Co.) were treated with the silane coupling agent shown as compound example (17) at a temperature of 150° C. for 2 hours), and were thereafter treated with the silane coupling agent shown as compound example (55) (at a temperature of 150° C. for 2 hours, thereby obtaining a treated fine silica powder in accordance with the present invention.

0.5 part of this treated silica powder was added to the outer surfaces of 100 parts of the above fine yellow powder particles, thereby obtaining a yellow toner.

6 parts of the obtained yellow toner was mixed with 100 parts of an acryl-coated ferrite carrier having an average particle size of 65 μm to form a two-component type developer.

This two-component type developer was used to effect a toner copying test in the same manner as Example 1.

An image obtained in an environment of a temperature of 23° C. and a humidity of 60% RH had a sufficiently high image density (1.42) and was clear. Also, the image was excellent in solid image density uniformity and in half-tone image reproducibility. Images were also formed in an environment of a temperature of 15° C. and a humidity of 10% RH, and an environment of a temperature of 35° C. and a humidity of 90% RH. These images had image densities of 1.40 and 1.40. Substantially no change in image density due to the environmental changes was observed. Substantially no changes in image quality with respect to solid image density uniformity and half-tone image reproducibility due to the environmental changes were observed.

The amounts of silanol groups remaining on the surface of the fine silica particles before and after the second treatment and the changes in the amount of triboelectric charge on the fine silica powder with respect to environmental changes were as shown in Table 1. As can be understood from Table 1, the amounts of triboelectric charge on the toner particles to which the fine silica powder was added reflect the characteristics of the added fine silica powder.

EXAMPLE 5

A full-color image was formed by using the black, cyan, magenta and yellow two-component type developers in accordance with Examples 1 to 4. The image was excellent in color mixing effect and gradation effect and had vivid colors. Further, good images were obtained under any of the above-described different conditions without adding special means to the copying machine.

Comparative Example 1

A cyan toner was obtained in the same manner as Example 2 except that 0.5 part of the fine silica powder made in accordance with Example 2 was changed to 0.5 part of a fine silica powder treated only with the silane coupling agent shown as compound example (4) (at 150° C. for 2 hours). A toner copying test was performed in the same manner as Example 2.

A good image having an image density of 1.40 was obtained in an environment of a temperature of 23° C. and a humidity of 60% RH, but the image density was reduced to 1.02 in an environment of a temperature of 35° C. and a humidity of 90% RH, because the amount of triboelectric charge on the fine silica powder was low, shown in Table 1, owing to low hydrophobicity of the fine silica powder.

Comparative Example 2

An electrostatic image development toner in accordance with the present invention was obtained in the same manner as Example 2, except that 0.5 part of the fine silica powder made in accordance with Example 2 was changed to 0.5 part of a fine silica powder treated only with the silane coupling agent shown as compound example (55) (at 150° C. for 2 hours). A toner copying test was performed in the same manner as Example 2.

A good image having an image density of 1.41 was obtained in an environment of a temperature of 23° C. and a humidity of 60% RH, but the image density was reduced to 0.99 in an environment of a temperature of 35° C. and a humidity of 90% RH, because the amount of triboelectric charge on the fine silica powder was low, shown in Table 1, owing to low hydrophobicity of the fine silica powder.

Comparative Example 3

A cyan toner was obtained in the same manner as Example 2, except that 0.5 part of the fine silica powder made in accordance with Example 2 was treated with the silane coupling agent shown as compound example (55) at 150° C. for 2 hours) and the silane coupling agent shown as compound example (4) (at 150° C. for 2 hours) in the reverse order. A toner copying test was performed in the same manner as Example 2.

A good image having an image density of 1.43 was obtained in an environment of a temperature of 23° C. and a humidity of 60% RH, but the image density was reduced to 1.06 in an environment of a temperature of 35° C. and a humidity of 90% RH, because the amount of triboelectric charge on the fine silica powder was low, as shown in Table 1, owing to low hydrophobicity of the fine silica powder.

EXAMPLE 6

| | |
|---|---|
| Polyester resin (Acid value: 10; OH value: 15) | 100 parts |
| Carbon black | 5 parts |
| Bis-azo Cr complex | 2 parts |

These materials were sufficiently mixed by a blender and were kneaded by a two-shaft kneading extruder set at 150° C. The kneaded mixture obtained was cooled, roughly pulverized by a cutter mill and thereafter pulverized finely by a pulverizer using a jet air flow. A finely pulverized powder thereby obtained was classified by a fixed-wall-type air classifier to obtain a refined classified powder.

Further, the resulting classified powder was strictly classified with respect to ultrafine and coarse powders simultaneously by a multiple-class classifier utilizing the Coanda effect (an elbow jet classifier manufactured by Nittetsu Kogyo K.K.), thereby obtaining a negatively chargeable fine black powder (toner particles) having a volume average particle size of 12.8 μm.

One hundred parts by weight of fine silica particles (Aerosil 200, manufactured by Nippon Aerosil Co.) were treated with 50 parts by weight of the silane coupling agent shown as compound example (26) (at a temperature of 150° C. for 2 hours), and were thereafter treated with the silane coupling agent shown as compound example (65) (at a temperature of 150° C. for 2 hours. A treated fine silica powder was thereby obtained in accordance with the present invention.

0.3 part of this treated fine silica powder was added to the outer surfaces of 100 parts of the above fine black powder particles, thereby obtaining a black toner.

5 parts of the resulting black toner was mixed with 100 parts of an acryl-coated ferrite carrier having an average particle size of 65 μm to form a two-component type developer.

This two-component type developer was used in a color copying machine on the marker (CLC-500, manufactured by Canon K.K.) to meet the requirements of a toner copying test without environmental correction.

An image obtained in an environment of a temperature of 23° C. and a humidity of 60% RH had a sufficiently high image density (1.42) was clear, and was excellent in solid image density uniformity and in half-tone image reproducibility. Images were also formed in an environment of a temperature of 15° C. and a humidity of 10% RH, and in an environment of a temperature of 35° C. and a humidity of 90% RH. These images had image densities of 1.40 and 1.39. Substantially no change in image density due to the environmental changes was observed. Substantially no changes in solid image density uniformity and half-tone image reproducibility due to the environmental changes were observed.

EXAMPLE 7

| | |
|---|---|
| Styrene/n-butyl methacrylate/divinylbenzene copolymer | 100 parts |
| Magnetic material | 60 parts |
| Low molecular weight polypropylene wax | 2 parts |
| Bis-azo Cr Complex | 2 parts |

These materials were sufficiently mixed by a blender and were kneaded by a two-shaft kneading extruder set at 150° C. The kneaded mixture obtained was cooled, roughly pulverized by a cutter mill and thereafter pulverized finely by a pulverizer using a jet air flow. A finely pulverized powder thereby obtained was classified by a fixed-wall-type air classifier to obtain a refined classified powder.

Further, the resulting classified powder was strictly classified with respect to ultrafine and coarse powders simultaneously by a multiple-class classifier utilizing the Coanda effect (an elbow jet classifier manufactured by Nittetsu Kogyo K.K.), thereby obtaining a negatively chargeable fine black powder (toner particles) having magnetic properties and having a volume average particle size of 11.3 μm.

One hundred parts by weight of fine silica particles (Aerosil 200, manufactured by Nippon Aerosil Co.) were treated with 50 parts by weight of the silane coupling agent shown as compound example (27) (at a temperature of 150° C. for 2 hours), and were thereafter treated with the silane coupling agent shown as compound example (54) (at a temperature of 150° C. for 2 hours), thereby obtaining a treated fine silica powder in accordance with the present invention.

0.4 part of this treated silica powder was exteriorly added to the outer surfaces of 100 parts of the above fine black powder particles having magnetic properties. A magnetic toner in accordance with the present invention was thereby obtained to be used as a one-component developer.

This one-component type developer was used in a color copying machine on the market (NP-6650, manufactured by Canon K.K.) to meet the requirements of a toner copying test.

An image obtained in an environment of a temperature of 23° C. and a humidity of 60% RH had a sufficiently high image density (1.41), was clear and was excellent in solid image density uniformity. Images were also formed in an environment of a temperature of 15° C. and a humidity of 10% RH, and in an environment of a temperature of 35° C. and a humidity of 90% RH. These images had image densities of 1.43 and 1.39. Substantially no change in image density due to the environmental changes was observed. Substantially no change in image quality with respect to solid image density uniformity due to the environmental changes was observed.

EXAMPLE 8

| | |
|---|---|
| Styrene/n-butyl methacrylate copolymer | 100 parts |
| Copper phthalocyanine pigment | 4 parts |
| Low molecular weight polypropylene wax | 3 parts |
| Cr complex of 3,5-di-t-butyl salicylate | 2 parts |

These materials were sufficiently mixed by a blender and were kneaded by a two-shaft kneading extruder set at 150° C. The kneaded mixture obtained was cooled, roughly pulverized by a cutter mill. A finely pulverized powder obtained was classified by a fixed-wall-type air classifier to obtain refined classified powder.

Further, the resulting classified powder was strictly classified with respect to ultrafine and coarse powders simultaneously by a multiple-class classifier utilizing the Coanda effect (an elbow jet classifier manufactured by Nittetsu Kogyo K.K.), thereby obtaining a negatively chargeable fine black powder (toner particles) having a volume average particle size of 11.3 μm.

One hundred parts by weight of fine silica particles (Aerosil 200, manufactured by Nippon Aerosil Co.) were treated with 50 parts by weight of the silane coupling agent shown as compound example (28) (at a temperature of 150° C. for 2 hours), and were thereafter treated with the silane coupling agent shown as compound example (62) (at a temperature of 150° C. for 2 hours), thereby obtaining a treated fine silica powder in accordance with the present invention.

0.4 part of this treated silica powder was added to the outer surfaces of 100 parts of the above fine blue powder particles, thereby obtaining a cyan toner.

5 parts of the obtained blue toner was mixed with 100 parts of an acryl-coated ferrite carrier having an average particle size of 65 μm to form a two-component type developer.

This two-component type developer was used in a color copying machine on the market (CLC-500, manufactured by Canon K.K.) to meet the requirements of a toner copying test without environmental correction.

An image obtained in an environment of a temperature of 23° C. and a humidity of 60% RH had a sufficiently high image density of (1.40) was clear, and was excellent in solid image density uniformity. Images were also formed in an environment of a temperature of 15° C. and a humidity of 10% RH and in an environment of a temperature of 35° C. and in a humidity of 90% RH. These images had image densities of 1.39 and 1.37. Substantially no change in image density due to the environmental changes was observed. Substantially no change in image quality with respect to solid image density uniformity due to the environmental changes was observed.

The amounts of silanol groups remaining in the surface of the fine silica particles before and after the second treatment and the changes in the amount of triboelectric charge on the fine silica powder with respect to environmental changes were as shown in Table 1. As can be understood from Table 1, the amounts of triboelectric charge on the toner particles to which the fine silica powder was added reflect the characteristics of the added fine silica powder.

Comparative Example 4

A cyan toner was obtained in the same manner as Example 8, except that 0.4 part of the fine silica powder made in accordance with Example 8 was changed to 0.5 part of a fine silica powder treated only with the silane coupling agent shown as compound example (28) (at 150° C. for 2 hours). A toner copying test was performed in the same manner as in Example 8.

A good image having an image density of 1.40 was obtained in an environment of a temperature of 23° C. and a humidity of 60% RH, but the image density was reduced to 1.02 in an environment of a temperature of 35° C. and a humidity of 90% RH, because the amount of triboelectric charge on the fine silica powder was low, as shown in Table 1, owing to insufficient hydrophobicity of the fine silica powder.

Comparative Example 5

A black toner was obtained in the same manner as Example 6, except that 0.3 part of the fine silica powder made in accordance with Example 6 was treated with the silane coupling agent shown as compound example

(65) (at 150° C. for 2 hours) and the silane coupling agent shown as compound example (26) in the reverse order. A toner copying test was performed in the same manner as in Example 6.

A good image having an image density of 1.44 was obtained in an environment of a temperature of 23° C. and a humidity of 60% RH, but the image density was reduced to 1.09 in an environment of a temperature of 35° C. and a humidity of 90%, because the amount of triboelectric charge on the fine silica powder was low, as shown in Table 1, owing to insufficient hydrophobicity of the fine silica powder.

TABLE 1

| | After First Treatment | | | After Second Treatment | | | Surface Added Toner (μc/g) | |
|---|---|---|---|---|---|---|---|---|
| | Remainder-OH (Number %)*1 | Silica Tribo-Electric Charge (μc/g) Under H/H Environment*2 | Under L/L Environment*3 | Remainder-OH- (Number %)*1 | Silica Tribo-Electric Charge (μc/g) Under H/H Environment*2 | Under L/L Environment*3 | Under H/H Environment*2 | Under L/L Environment*3 |
| Example 1 | 40 | −72 | −83 | 11 | −76 | −79 | −21 | −24 |
| Example 2 | 40 | −72 | −83 | 9 | −76 | −79 | −21 | −24 |
| Example 3 | 47 | −66 | −78 | 10 | −54 | −57 | −20 | −22 |
| Example 4 | 47 | −66 | −78 | 14 | −54 | −57 | −20 | −22 |
| Example 8 | 68 | −51 | −59 | 18 | −63 | −65 | −20 | −21 |
| Comparative Example 1 | 40 | −72 | −82 | | — | | −23 | −34 |
| Comparative Example 2 | 13 | −94 | −137 | | — | | −22 | −38 |
| Comparative Example 3 | 13 | −94 | −139 | 12 | −91 | −125 | −22 | −36 |
| Comparative Example 4 | 68 | −51 | −59 | | — | | −21 | −32 |
| Comparative Example 5 | 12 | −101 | −162 | 12 | −98 | −149 | −21 | −36 |

*1The amounts of silanol groups remaining on the surface of the fine silica
*2In an environment of a temperature of 35° C. and a humidity of 90% RH.
*3In an environment of a temperature of 15° C. and a humidity of 10% RH.

What is claimed is:

1. A treated fine silica powder comprising treated fine particles of silica having a negatively chargeable property, said treated fine particles of silica being obtained by (a) treating fine particles of silica with a first silane coupling agent in which at least one of
  (i) a secondary alkyl group substituted with at least one substituent group selected from the group consisting of a halogen group, a phenyl group and derivatives of the phenyl group,
  (ii) an unsubstituted secondary alkyl group,
  (iii) a tertiary alkyl group substituted with at least one substituent group selected from the group consisting of a halogen group, a phenyl group and derivatives of the phenyl group,
  (iv) an unsubstituted tertiary alkyl group,
  (v) a cyclic hydrocarbon group substituted with an alkyl group having 1 to 8 carbon atoms, and
  (vi) an unsubstituted cyclic hydrocarbon group is bonded to a silicon atom of said first coupling agent through a secondary carbon atom or a tertiary carbon atom, and (b) thereafter, further treating the resulting fine particles of silica with a second silane coupling agent represented by the following formula:

$$(R_1)_m—Si—(Y)_n$$

wherein $R_1$ represents a methyl group, a halomethyl group, a saturated straight chain hydrocarbon group or an unsaturated straight chain hydrocarbon group; Y represents an alkoxy group or a halogen group; m represents an integer of 1 to 3; n represents an integer of 1 to 3; and the sum of m plus n is 4.

2. The treated silica fine powder according to claim 1, wherein the powder has a BET specific surface area of 30 $m^2/g$ or greater.

3. The treated silica fine powder according to claim 1, wherein the first silane coupling agent for treating the fine particles of silica comprises a silane coupling agent in which one of (a) a secondary alkyl group having 3 to 18 carbon atoms and
(b) a tertiary alkyl group having 4 to 18 carbon atoms is bonded to a silicon atom of said coupling agent.

4. The treated silica fine powder according to claim 1, wherein the first silane coupling agent for treating the fine particles of silica comprises a silane coupling agent in which a cyclic hydrocarbon group comprising a phenyl group, a derivative of the same, a cyclohexyl group or a derivative of the same, is bonded to a silicon atom of said coupling agent.

5. The treated silica fine powder according to claim 1, wherein the second silane coupling agent for treating the fine particles of silica comprises a silane coupling agent in which an alkoxy group having 1 or 2 carbon atoms and a substituent group represented by the following formula:

$$-CH_2R_1$$

where $R_1$ represents one of a saturated straight chain hydrocarbon having 1 to 3 carbon atoms and an unsaturated straight chain hydrocarbon having 1 to 3 carbon atoms, are bonded to a silicon atom of said coupling agent.

6. A toner for developing electrostatic images comprising toner particles and a treated silica fine powder, wherein said toner particles comprise a binder resin and a colorant, and said treated silica fine powder comprises treated fine particles of silica having a negatively chargeable property, said treated fine particles of silica being obtained by (a) treating fine particles of silica with a first silane coupling agent in which at least one of (i) a secondary alkyl group substituted with at least one substituent group selected from the group consisting of a halogen group, a phenyl group and derivatives of the phenyl group, (ii) an unsubstituted secondary alkyl group, (iii) a tertiary alkyl group substituted with at least one substituent group selected from the group consisting of a halogen group, a phenyl group and derivatives of the phenyl group, (iv) an unsubstituted tertiary alkyl group, (v) a cyclic hydrocarbon group substituted with an alkyl group having 1 to 8 carbon atoms, and (vi) an unsubstituted cyclic hydrocarbon group is bonded to a silicon atom of said first coupling agent through a secondary carbon atom or a tertiary carbon atom, and (b) thereafter, further treating the resulting fine particles of silica with a second silane coupling agent represented by the following formula:

$$(R_1)_m—Si—(Y)_n$$

wherein $R_1$ represents a methyl group, a halomethyl group, a saturated straight chain hydrocarbon group or an unsaturated straight chain hydrocarbon group; Y represents an alkoxy group or a halogen group; m represents an integer of 1 to 3; n represents an integer of 1 to 3; and the sum of m plus n is 4.

7. The toner according to claim 6, wherein the treated silica fine powder has a BET specific surface area of 30 $m^2/g$ or above.

8. The toner according to claim 6, herein the first silane coupling agent for treating the fine particles of silica comprises a silane coupling agent in which one of (a) a secondary alkyl group having 3 to 18 carbon atoms and (b) a tertiary alkyl group having 4 to 18 carbon atoms is bonded to a silicon atom of said coupling agent.

9. The toner according to claim 6, wherein the first silane coupling agent for treating the fine particles of silica comprises a silane coupling agent in which a cyclic hydrocarbon group selected from the group consisting of a phenyl group, a derivative of the same, a cyclohexyl group and a derivative of the same, is bonded to a silicon group of said coupling agent.

10. The toner according to claim 6, wherein the second silane coupling agent for treating the fine particles of silica comprises a silane coupling agent in which an alkoxy group having 1 or 2 carbon atoms, and a substituent group represented by the following formula:

$$-CH_2R_1$$

where $R_1$ represents one of a saturated straight chain hydrocarbon having 1 to 3 carbon atoms and an unsaturated straight chain hydrocarbon having 1 to 3 carbon atoms, are bonded to a silicon atom of said coupling agent.

11. The toner according to claim 6, wherein the toner is used as a two-component type developer by being mixed with a carrier.

12. The toner according to claim 6, wherein the toner comprises magnetic toner particles containing a magnetic material and is used as a one-component type developer.

13. The toner according to claim 6, wherein the toner is used as a color toner for forming a full-color image.

14. The toner according to claim 6, wherein the second silane coupling agent for treating the fine particles of silica comprises a silane coupling agent in which a halogen group and a substituent group represented by the following formula:

$$-CH_2R_1$$

where $R_1$ represents one of a saturated straight chain hydrocarbon having 1 to 3 carbon atoms and an unsaturated straight chain hydrocarbon having 1 to 3 carbon atoms, are bonded to a silicon atoms of said coupling agent.

15. The toner according to claim 6, wherein the second silane coupling agent for treating the fine particles of silica comprises a silane coupling agent in which an alkoxy group having 1 or 2 carbon atoms, a halogen group and a substituent group represented by the following formula:

$$-CH_2R_1$$

where $R_1$ represents one of a saturated straight chain hydrocarbon having 1 to 3 carbon atoms and an unsaturated straight chain hydrocarbon having 1 to 3 carbon atoms, are bonded to a silicon atom of said coupling agent.

16. The treated silica fine powder according to claim 1, wherein the second silane coupling agent for treating the fine particles of silica comprises a silane coupling agent in which a halogen group and a substituent group represented by the following formula:

$$-CH_2R_1$$

where $R_1$ represents one of a saturated straight chain hydrocarbon having 1 to 3 carbon atoms and an unsaturated straight chain hydrocarbon having 1 to 3 carbon atoms, are bonded to a silicon atom of said coupling agent.

17. The treated silica fine powder according to claim 1, wherein the second silane coupling agent for treating the fine particles of silica comprises a silane coupling agent in which an alkoxy group having 1 or 2 carbon atoms, a halogen group and a substituent group represented by the following formula:

$$-CH_2R_1$$

where $R_1$ represents one of a saturated straight chain hydrocarbon having 1 to 3 carbon atoms and an unsaturated straight chain hydrocarbon having 1 to 3 carbon atoms, are bonded to a silicon atom of said coupling agent.

* * * * *

UNITED STATES PATENT AND TRADEMARK OFFICE

CERTIFICATE OF CORRECTION

PATENT NO. : 5,306,588

DATED : April 26, 1994

INVENTOR(S) : KATSUHIKO TANAKA, ET AL.

It is certified that error appears in the above-identified patent and that said Letters Patent is hereby corrected as shown below:

On the title page, in the Abstract, line 1 after the formula, "R1" should read --$R_1$--.

COLUMN 1

Line 19, "ar" should read --are--.
Line 28, "and" should be deleted.
Line 56, "ther" should read --ther,--.
Line 58, "capable" should read --capable of--.

COLUMN 2

Line 4, ""that," should read --that,--.
Line 5, "is"" should read --is--.
Line 6, "upon" should read --upon the--.
Line 36, "R1" should read --$R_1$--.
Line 39, "alkoxyl" should read --alkoxy--.
Line 41, "1 to 3" should read --1 to 3;--.
Line 52, "of a" should read --of a group consisting of a--.
Line 57, "group (2)" should read --group; and (2)--.
Line 62, "R1" should read --$R_1$--.
Line 65, "represent" should read --represents--.

COLUMN 3

Line 20, "Alternately," should read --Alternatively,--.
Line 25, "particle" should read --particle,--.
Line 37, "dimethyldichlorosilane" should read --dimethyldichlorosilane,--.
Line 43, "water" (first occurrence) should read --water,--.
Line 62, "environment" should read --improvement--.

UNITED STATES PATENT AND TRADEMARK OFFICE

CERTIFICATE OF CORRECTION

PATENT NO. : 5,306,588

DATED : April 26, 1994

INVENTOR(S) : KATSUHIKO TANAKA, ET AL.

It is certified that error appears in the above-identified patent and that said Letters Patent is hereby corrected as shown below:

COLUMN 4

Line 18, "develop" should read --develop a--.
Line 20, "removed" should read --removed,-- and "a" should be deleted.
Line 39, "and" should be deleted.

COLUMN 11

Line 6, "SiCl(48)" should read --SiCl (48)--.
Line 15, "SiCl(49)" should read --SiCl (49)--.
Line 25, "$Si(CH_3)Cl(50)$" should read --$Si(CH_3)Cl$ (50)--.
Line 43, "Where" should read --where--.
Line 53, "Where" should read --where--.
Line 55, "are" should be deleted.
Line 62, "formula" should read --formula,--.

COLUMN 12

Line 4, "$CH_3)_2Si(OCH_3)_2$" should read --$(CH_3)_2Si(OCH_3)_2$--.

COLUMN 13

Line 46, "Hanza" should read --Hansa--.
Line 48, "Bengale," should read --Bengal,--.
Line 51, "images;" should your --images--.

UNITED STATES PATENT AND TRADEMARK OFFICE

CERTIFICATE OF CORRECTION

PATENT NO. : 5,306,588

DATED : April 26, 1994

INVENTOR(S) : KATSUHIKO TANAKA, ET AL.

It is certified that error appears in the above-identified patent and that said Letters Patent is hereby corrected as shown below:

COLUMN 14

Line 36, "of" should read --or--.
Line 42, "polymerization" should read --a polymerization--.
Line 46, "particles" should read --particles;--.

COLUMN 15

Line 21, "preferably" should read --preferably,--.

COLUMN 16

Line 1, insert: --EXAMPLE 1--.
Line 10, "and thereafter" should read --and, thereafter,--.
Line 20, "Nitetsu" should read --Nittetsu--.
Line 30, "2," should read --2 hours,--.

COLUMN 17

Line 19, "powder," should read --powder particles,--.
Line 61, "hours)," should read --hours,--.
Line 62, "(at" should read --at--.

COLUMN 18

Line 31, "EXAMPLE 4" should be centered.
Line 40, "hours)," should read --hours,--.
Line 41, "(at" should read --at--.

COLUMN 19

Line 53, "shown" should read --as shown--.
Line 61, "at" should read --(at--.

UNITED STATES PATENT AND TRADEMARK OFFICE

CERTIFICATE OF CORRECTION

PATENT NO. : 5,306,588

DATED : April 26, 1994

INVENTOR(S) : KATSUHIKO TANAKA, ET AL.

It is certified that error appears in the above-identified patent and that said Letters Patent is hereby corrected as shown below:

COLUMN 20

Line 33, "(at" should read --at--.
Line 49, "(1.42)" should read --(1.42),--.

COLUMN 21

Line 25, "exteriorly" should be deleted.
Line 37, "clear" should read --clear,--.

COLUMN 22

Line 1, "black" should read --blue--.
Line 25, "(1.40)" should read --(1.40),--.

COLUMN 23

TABLE 1, "-82" should read -- -83--.

COLUMN 25

Line 58, "herein" should read --wherein--.

UNITED STATES PATENT AND TRADEMARK OFFICE

CERTIFICATE OF CORRECTION

PATENT NO. : 5,306,588

DATED : April 26, 1994

INVENTOR(S) : KATSUHIKO TANAKA, ET AL.

It is certified that error appears in the above-identified patent and that said Letters Patent is hereby corrected as shown below:

COLUMN 26

Line 40, "atoms" should read --atom--.

Signed and Sealed this

Twenty-first Day of February, 1995

*Attest:*

*Attesting Officer*

BRUCE LEHMAN

*Commissioner of Patents and Trademarks*